US006388161B1

(12) United States Patent
Dath et al.

(10) Patent No.: US 6,388,161 B1
(45) Date of Patent: May 14, 2002

(54) PRODUCTION OF OLEFINS

(75) Inventors: Jean-Pierre Dath, Beloeil; Walter Vermeiren, Houthalen, both of (BE)

(73) Assignee: Fina Research, S.A., Feluy (BE)

( * ) Notice: Subject to any disclaimer, the term of this patent is extended or adjusted under 35 U.S.C. 154(b) by 38 days.

(21) Appl. No.: 09/594,282

(22) Filed: Jun. 15, 2000

(30) Foreign Application Priority Data

Jun. 16, 1999 (BE) ..... 99111643

(51) Int. Cl.[7] ..... C10G 47/02; C10G 47/04; C07C 4/02

(52) U.S. Cl. ..... 585/648; 585/650; 585/651; 585/653; 208/109; 208/113; 208/114; 208/118

(58) Field of Search ..... 585/648, 650, 585/651, 653; 208/109, 113, 114, 118

(56) References Cited

FOREIGN PATENT DOCUMENTS

EP 0109059 A1 * 5/1984
EP 0921177 A1 * 6/1999

* cited by examiner

*Primary Examiner*—Walter D. Griffin
*Assistant Examiner*—Tam M. Nguyen
(74) *Attorney, Agent, or Firm*—William D. Jackson

(57) ABSTRACT

A process for cracking an olefin-rich hydrocarbon feedstock which is selective towards propylene in the effluent, the process comprising contacting a hydrocarbon feedstock containing one or more olefinic components of $C_4$ or greater with a crystalline silicate catalyst to produce an effluent having a second composition of one or more olefinic components of $C_3$ or greater, the feedstock and the effluent having substantially the same olefin content by weight therein characterized in that ethylene is added to the feedstock before the feedstock contacts the catalyst.

20 Claims, 4 Drawing Sheets

PRODUCTION OF OLEFINS

BACKGROUND TO THE INVENTION

The present invention relates to a process for cracking an olefin-rich hydrocarbon feedstock which is selective towards propylene in the effluent. In particular, olefinic feedstocks from refineries or petrochemical plants can be converted selectively so as to redistribute the olefin content of the feedstock in the resultant effluent thereby to provide a recoverable propylene content.

DESCRIPTION OF THE PRIOR ART

It is known in the art to use zeolites to convert long chain paraffins into lighter products, for example in the catalytic dewaxing of petroleum feedstocks. While it is not the objective of dewaxing, at least parts of the paraffinic hydrocarbons are converted into olefins. It is known in such processes to use crystalline silicates for example of the MFI type, the three-letter designation "MFI" representing a particular crystalline silicate structure type as established by the Structure Commission of the International Zeolite Association. Examples of a crystalline silicate of the MFI type are the synthetic zeolite ZSM-5 and silicalite and other MFI type crystalline silicates are known in the art. GB-A-1323710 discloses a dewaxing process for the removal of straight-chain paraffins and slightly branched-chain paraffins, from hydrocarbon feedstocks utilising a crystalline silicate catalyst, in particular ZSM-5. U.S. Pat. No. 4,247,388 also discloses a method of catalytic hydrodewaxing of petroleum and synthetic hydrocarbon feedstocks using a crystalline silicate of the ZSM-5 type. Similar dewaxing processes are disclosed in U.S. Pat. No. 4,284,529 and U.S. Pat. No. 5,614,079. The catalysts are crystalline aluminosilicates and the above-identified prior art documents disclose the use of a wide range of Si/Al ratios and differing reaction conditions for the disclosed dewaxing processes.

GB-A-2185753 discloses the dewaxing of hydrocarbon feedstocks using a silicalite catalyst. U.S. Pat. No. 4,394,251 discloses hydrocarbon conversion with a crystalline silicate particle having an aluminium-containing outer shell.

It is also known in the art to effect selective conversion of hydrocarbon feeds containing straight-chain and/or slightly branched-chain hydrocarbons, in particular paraffins, into a lower molecular weight product mixture containing a significant amount of olefins. The conversion is effected by contacting the feed with a crystalline silicate known as silicalite, as disclosed in GB-A-2075045, U.S. Pat No. 4,401,555 and U.S. Pat. No. 4,309,276. Silicalite is disclosed in U.S. Pat. No. 4,061,724.

Silicalite catalysts exist having varying silicon/aluminium atomic ratios and different crystalline forms. EP-A-0146524 and 0146525 in the name of Cosden Technology, Inc. disclose crystalline silicas of the silicalite type having monoclinic symmetry and a process for their preparation. These silicates have a silicon to aluminium atomic ratio of greater than 80.

WO-A-97/04871 discloses the treatment of a medium pore zeolite with steam followed by treatment with an acidic solution for improving the butene selectivity of the zeolite in catalytic cracking.

A paper entitled "De-alumination of HZSM-5 zeolites: Effect of steaming on acidity and aromatization activity", de Lucas et al, Applied Catalysis A: General 154 1997 221–240, published by Elsevier Science B. V. discloses the conversion of acetone/n-butanol mixtures to hydrocarbons over such dealuminated zeolites.

It is yet further known, for example from U.S. Pat. No. 4,171,257, to dewax petroleum distillates using a crystalline silicate catalyst such as ZSM-5 to produce a light olefin fraction, for example a $C_3$ to $C_4$ olefin fraction. Typically, the reactor temperature reaches around 500° C. and the reactor employs a low hydrocarbon partial pressure which favours the conversion of the petroleum distillates into propylene. Dewaxing cracks paraffinic chains leading to a decrease in the viscosity of the feedstock distillates, but also yields a minor production of olefins from the cracked paraffins.

EP-A-0305720 discloses the production of gaseous olefins by catalytic conversion of hydrocarbons. EP-B-0347003 discloses process, for the conversion of a hydrocarbonaceous feedstock into light olefins. WO-A-90/11338 discloses a process for the conversion of $C_2$–$C_{12}$ paraffinic hydrocarbons to petrochemical feedstocks, in particular to $C_2$ to $C_4$ olefins. U.S. Pat. No. 5,043,522 and EP-A-0395345 disclose the production of olefins from paraffins having four or more carbon atoms. EP-A-0511013 discloses the production of olefins from hydrocarbons using a steam activated catalyst containing phosphorous and H-ZSM-5. U.S. Pat. No. 4,810,356 discloses a process for the treatment of gas oils by dewaxing over a silicalite catalyst. GB-A-2156845 discloses the production of isobutylene from propylene or a mixture of hydrocarbons containing propylene. GB-A-2159833 discloses the production of isobutylene by the catalytic cracking of light distillates.

It is known in the art that for the crystalline silicates exemplified above, long chain olefins tend to crack at a much higher rate than the corresponding long chain paraffins.

It is further known that, when crystalline silicates are employed as catalysts for the conversion of paraffins into olefins, such conversion is not stable against time. The conversion rate decreases as the time on stream increases, which is due to formation of coke (carbon) which is deposited on the catalyst.

These known processes are employed to crack heavy paraffinic molecules into lighter molecules. However, when it is desired to produce propylene, not only are the yields low but also the stability of the crystalline silicate catalyst is low. For example, in an FCC unit a typical propylene output is 3.5 wt %. The propylene output may be increased to up to about 7–8 wt % propylene from the FCC unit by introducing the known ZSM-5 catalyst into the FCC unit to "squeeze" out more propylene from the incoming hydrocarbon feedstock being cracked. Not only is this increase in yield quite small, but also the ZSM-5 catalyst has low stability in the FCC unit.

There is an increasing demand for propylene in particular for the manufacture of polypropylene.

The petrochemical industry is presently facing a major squeeze in propylene availability as a result of the growth in propylene derivatives, especially polypropylene. Traditional methods to increase propylene production are not entirely satisfactory. For example, additional naphtha steam cracking units which produce about twice as much ethylene as propylene are an expensive way to yield propylene since the feedstock is valuable and the capital investment is very high. Naphtha is in competition as a feedstock for steam crackers because it is a base for the production of gasoline in the refinery. Propane dehydrogenation gives a high yield of propylene but the feedstock (propane) is only cost effective during limited periods of the year, making the process expensive and limiting the production of propylene. Propylene is obtained from FCC units but at a relatively low yield and increasing the yield has proven to be expensive and limited. Yet another route known as metathesis or disproportionation enables the production of propylene from ethylene and butene. Often, combined with a steam cracker, this technology is expensive since it uses ethylene as a feedstock which is at least as valuable as propylene.

EP-A-0109059 discloses a process for converting olefins having 4 to 12 carbon atoms into propylene. The olefins are contacted with an alumino-silicate having a crystalline and zeolite structure (e.g. ZSM-5 or ZSM-11) and having a $SiO_2/Al_2O_3$ molar ratio equal to or lower than 300. The specification requires high space velocities of greater than 50 kg/h per kg of pure zeolite in order to achieve high propylene yield. The specification also states that generally the higher the space velocity the lower the $SiO_2/Al_2O_3$ molar ratio (called the Z ratio). This specification only exemplifies olefin conversion processes over short periods (e.g. a few hours) and does not address the problem of ensuring that the catalyst is stable over longer periods (e.g. at least a few days) which are required in commercial production. Moreover, the requirement for high space velocities is undesirable for commercial implementation of the olefin conversion process.

Thus there is a need for a high yield propylene production method which can readily be integrated into a refinery or petrochemical plant, taking advantage of feedstocks that are less valuable for the market place (having few alternatives on the market).

EP-A-0921179, EP-A-0921177 and EP-A-0921176 all in the name of Fina Research S.A. disclose processes for the production of propylene by catalytic cracking of an olefin-containing feedstock. The feedstock contains olefins of $C_4$ or greater. Although the propylene yield is high, there is a need to improve the yield yet further, particularly over long cycle times of the catalyst.

It is also disclosed in EP-A-0921179 and EP-A-0921177 that in order to provide a stable catalyst, when the hydrocarbon feedstock contains one or more dienes, together with the olefins, the dienes are hydrogenated prior to the catalytic cracking process. Typically, the hydrogenation is performed over a palladium-based catalyst. The reason that dienes are removed prior to the catalytic cracking process is that dienes tend to form coke precursors for the crystalline silicate catalysts. When coke is deposited on the catalyst, the catalysts are gradually deactivated. The applicant has found that even if the hydrocarbon feed has been hydrotreated by employing a hydrogenation process upstream of the catalytic cracking process, dienes are always detected at the outlet of the catalytic cracking reactor. Thus there is a need for an improved method for removing the presence of dienes or coke precursors in the catalytic cracking process, thereby to achieve reduced deactivation of the catalyst. Moreover, it would be desirable to avoid having to perform a separate hydrogenation step upstream of the catalytic cracking step.

On the other hand, crystalline silicates of the MFI type are also well known catalysts for the oligomerisation of olefins. For example, EP-A-0031675 discloses the conversion of olefin-containing mixtures to gasoline over a catalyst such as ZSM-5. As will be apparent to a person skilled in the art, the operating conditions for the oligomerisation reaction differ significantly from those used for cracking. Typically, in the oligomerisation reactor the temperature does not exceed around 400° C. and a high pressure favours the oligomerisation reactions.

GB-A-2156844 discloses a process for the isomerisation of olefins over silicalite as a catalyst. U.S. Pat. No. 4,579,989 discloses the conversion of olefins to higher molecular weight hydrocarbons over a silicalite catalyst. U.S. Pat. No. 4,746,762 discloses the upgrading of light olefins to produce hydrocarbons rich in $C_5$+ liquids over a crystalline silicate catalyst. U.S. Pat. No. 5,004,852 discloses a two-stage process for conversion of olefins to high octane gasoline wherein in the first stage olefins are oligomerised to $C_5$+ olefins. U.S. Pat. No. 5,171,331 discloses a process for the production of gasoline comprising oligomerising a $C_2$–$C_6$ olefin containing feedstock over an intermediate pore size siliceous crystalline molecular sieve catalyst such as silicalite, halogen stabilised silicalite or a zeolite. U.S. Pat. No. 4,414,423 discloses a multistep process for preparing high-boiling hydrocarbons from normally gaseous hydrocarbons, the first step comprising feeding normally gaseous olefins over an intermediate pore size siliceous crystalline molecular sieve catalyst. U.S. Pat. No. 4,417,088 discloses the dimerising and trimerising of high carbon olefins over silicalite. U.S. Pat. No. 4,417,086 discloses an oligomerisation process for olefins over silicalite. GB-A-2106131 and GB-A-2106132 disclose the oligomerisation of olefins over catalysts such as zeolite or silicalite to produce high boiling hydrocarbons. GB-A-2106533 discloses the oligomerisation of gaseous olefins over zeolite or silicalite.

DE-A-3708332 discloses a process for the thermal conversion of ethylene, in a mixture with naphtha, in a steam cracker.

SUMMARY OF THE INVENTION

It is an object of the present invention to provide a process for using the less valuable olefins present in refinery and petrochemical plants as a feedstock for a process which, in contrast to the prior art processes referred to above, catalytically converts olefins into lighter olefins, and in particular propylene.

It is another object of the invention to provide a process for producing propylene having a high propylene yield and purity.

It is a further object of the present invention to provide such a process which can produce olefin effluents which are within, at least, a chemical grade quality.

It is yet a further object of the present invention to provide a process for producing olefins having a stable olefinic conversion and a stable product distribution over time.

It is yet a further object of the present invention to provide a process for converting olefinic feedstocks having a high yield on an olefin basis towards propylene, irrespective of the origin and composition of the olefinic feedstock.

The present invention provides a process for cracking an olefin-rich hydrocarbon feedstock which is selective towards propylene in the effluent, the process comprising contacting a hydrocarbon feedstock containing one or more olefinic components of $C_4$ or greater with a crystalline silicate catalyst to produce an effluent having a second composition of one or more olefinic components of $C_3$ or greater, the feedstock and the effluent having substantially the same olefin content by weight therein characterised in that ethylene is added to the feedstock before the feedstock contacts the catalyst.

Preferably, at least a part of the ethylene is recycled from the effluent.

More preferably, the ethylene comprises from 0.1 to 50 wt % of the hydrocarbon feedstock.

The process may further comprise adding to the feedstock hydrogen gas at a hydrogen partial pressure of up to 15 bar.

The hydrogen partial pressure can be varied depending on the composition of the feedstock, the LHSV and the nature of the catalyst. The hydrogen partial pressure is preferably up to 15 bar, more preferably up to 7.5 bar, yet more preferably from 0.1 to 7.5 bar and most preferably from 0.1 to 5 bar. In order to retain the olefinicity of the hydrocarbons i.e. to ensure that the feedstock and effluent have substantially the same olefin content, the hydrogen partial pressure is typically up to 7.5 bar when the olefin partial pressure and the LHSV are kept within readily implementable ranges (i.e. olefinic partial pressure of from 0.1 to 2 bar and LHSV of from 10 to 30 $h^{-1}$) with the preferred catalysts of the invention. However, although the olefinicity tends to decrease with increasing hydrogen partial pressure as a result of hydrogenation of the olefins to form paraffins, a hydrogen partial pressure of up to 15 bar can be employed by utilising different olefin partial pressures, LHSV's and catalysts.

The hydrogen may be pure or impure hydrogen and freshly introduced into the catalytic cracker or recycled from another step or process.

In one preferred arrangement, both the ethylene and the hydrogen are together recycled as a common stream, back into the feedstock from the effluent.

The present invention can thus provide a process wherein olefin-rich hydrocarbon streams (products) from refinery and petrochemical plants are selectively cracked not only into light olefins, but particularly into propylene. The olefin-rich feedstock may be passed over a crystalline silicate catalyst with a particular Si/Al atomic ratio of at least 180 for example by synthesis or obtained after a steaming/dealumination treatment. The feedstock may be passed over the catalyst at a temperature ranging between 500 to 600° C., an olefin partial pressure of from 0.1 to 2 bars and an LHSV of from 10 to 30 $h^{-1}$ to yield at least 30 to 50% propylene based on the olefin content in the feedstock.

The present invention is predicated on the discovery by the present inventors that the addition of ethylene, either pure or impure, fresh or recycled, to the feedstock, optionally together with $C_5$ and/or $C_6$ olefins, can increase the yield of propylene in the selective catalytic cracking of an olefin-containing feedstock containing primarily $C_4$ olefins. Ethylene may be introduced together with the hydrogen feed. When ethylene is added to the feedstock in this way, around 20% of the ethylene is converted into other olefins with a propylene selectivity of typically at least around 20%. The amount of ethylene added may vary from about 0.1 to about 50 wt % based on the weight of the remaining constituents of the feedstock.

The ethylene may be introduced together with an additional feed of $C_5$ and/or $C_6$ olefins. This in turn increases the propylene yield. Such a combined feed avoids the requirement to separate recycled ethylene from hydrogen and methane and also gives an overall propylene yield of around 30 to 50% on an olefin basis.

The inventors have also found, with respect to a preferred aspect of the invention, that dienes are always detected at the outlet of the catalytic cracking reactor even if the feed had been hydrotreated before the catalytic cracking step in an attempt to hydrogenate dienes to form olefins. The present inventors concluded that dienes may be accordingly formed in the catalytic cracking reactor as a result of degradation of the olefins. Thus without being bound by theory it is believed by the present inventors that the addition of hydrogen to the feedstock enhances the stability of the catalyst by reducing coke precursor formation by reducing the formation of dienes and/or by reducing the dehydrogenation of dienes into coke precursors.

Accordingly, the inventors have found that the addition of hydrogen to the olefin-containing feedstock should limit the formation of dienes, and in turn should limit any catalyst deactivation. The addition of hydrogen to the feedstock is believed (without being bound by theory) to tend to drive the reaction to form dienes in the opposite direction thereby altering the thermodynamic equilibrium of the degradation of the olefins. In this way, reduced presence of dienes in the catalytic cracker tends to reduce the formation of coke on the catalyst, and thus increases the stability of the catalyst. The inventors have also found that $C_4$ dienes tend to be less detrimental to as regards coke formation than $C_5$ or $C_6$ dienes.

This addition of hydrogen avoids the requirement for selective hydrogenation of the dienes upstream of the catalytic cracking process. This also tends to increase the cycle time for any given catalyst i.e. the time between successive catalyst regenerations.

In this specification, the term "silicon/aluminium atomic ratio" is intended to mean the Si/Al atomic ratio of the overall material, which may be determined by chemical analysis. In particular, for crystalline silicate materials, the stated Si/Al ratios apply not just to the Si/Al framework of the crystalline silicate but rather to the whole material.

The silicon/aluminium atomic ratio is preferably greater than about 180. Even at silicon/aluminum atomic ratios less than about 180, the yield of light olefins, in particular propylene, as a result of the catalytic cracking of the olefin-rich feedstock may be greater than in the prior art processes. The feedstock may be fed either undiluted or diluted with an inert gas such as nitrogen. In the latter case, the absolute pressure of the feedstock constitutes the partial pressure of the hydrocarbon feedstock in the inert gas, and in the ethylene, and in the hydrogen when present.

BRIEF DESCRIPTION OF THE DRAWINGS

The various aspects of the present invention will now be described in greater detail by example only with reference to the accompanying drawings, in which.

DETAILED DESCRIPTION OF THE PREFERRED EMBODIMENTS

Figure 1:
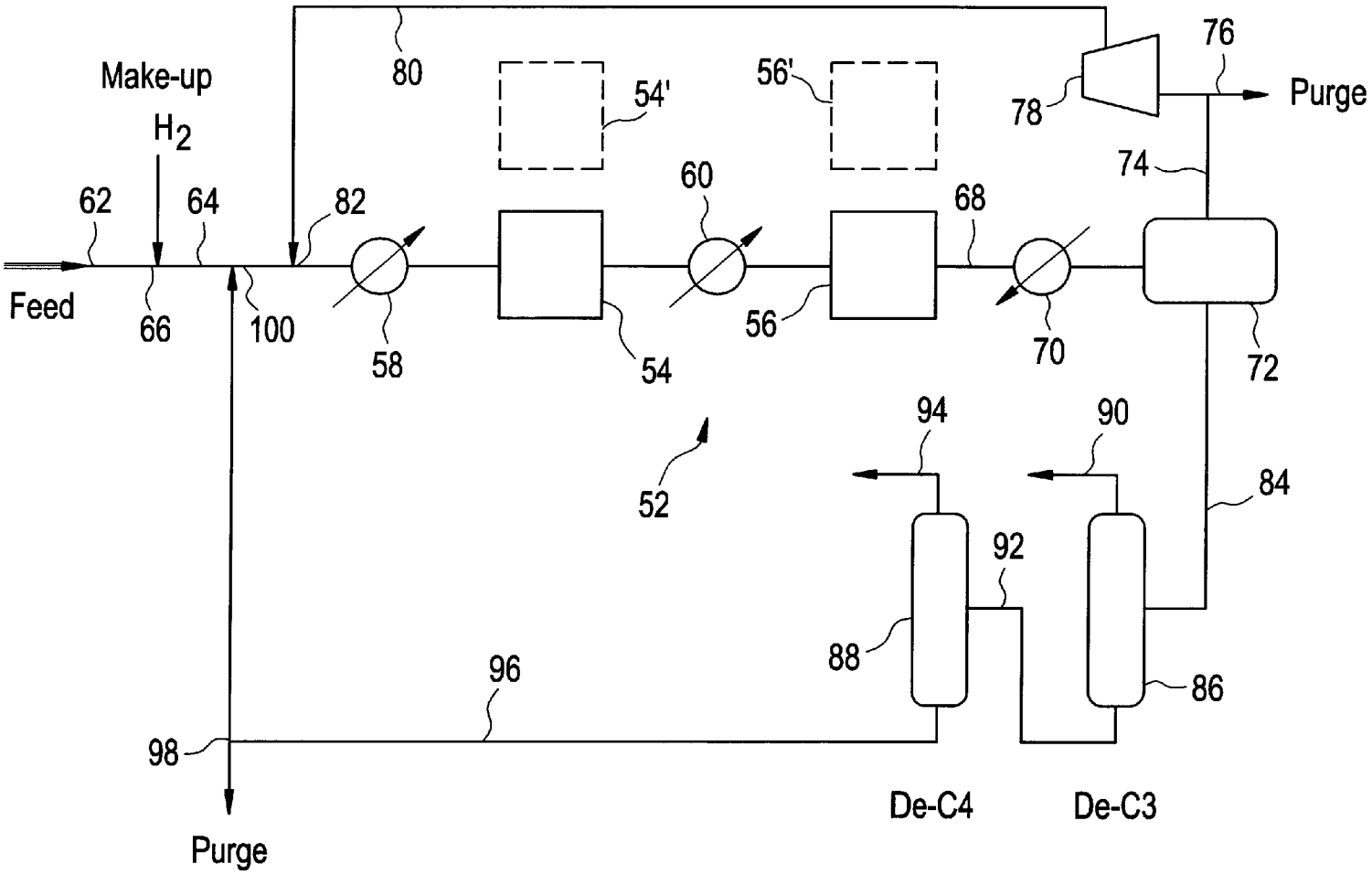
FIG. 1 shows a schematic diagram of a process flow for a process for cracking an olefin-rich hydrocarbon feedstock in accordance with a first embodiment of the present invention.

In accordance with the present invention, cracking of olefins is performed in the sense that olefins in a hydrocarbon stream are cracked into lighter olefins and selectively into propylene. The feedstock and effluent preferably have substantially the same olefin content by weight. Typically, the olefin content of the effluent is within ±15 wt %, more preferably ±10 wt %, of the olefin content of the feedstock. The feedstock may comprise any kind of olefin-containing hydrocarbon stream. The feedstock may typically comprise from 10 to 100 wt % olefins and furthermore may be fed undiluted or diluted by a diluent, the diluent optionally including a non-olefinic hydrocarbon. In particular, the olefin-containing feedstock may be a hydrocarbon mixture containing normal and branched olefins in the carbon range $C_4$ to $C_{10}$, more preferably in the carbon range $C_4$ to $C_6$, optionally in a mixture with normal and branched paraffins and/or aromatics in the carbon range $C_4$ to $C_{10}$. Typically, the olefin-containing stream has a boiling point of from around −15 to around 180° C.

In particularly preferred embodiments of the present invention, the hydrocarbon feedstocks comprise $C_4$ mixtures from refineries and steam cracking units. Such steam cracking units crack a wide variety of feedstocks, including ethane, propane, butane, naphtha, gas oil, fuel oil, etc. Most particularly, the hydrocarbon feedstock may comprises a $C_4$ cut from a fluidized-bed catalytic cracking (FCC) unit in a crude oil refinery which is employed for converting heavy oil into gasoline and lighter products. Typically, such a $C_4$ cut from an FCC unit comprises around 50 wt % olefin. Alternatively, the hydrocarbon feedstock may comprise a $C_4$ cut from a unit within a crude oil refinery for producing methyl tert-butyl ether (MTBE) which is prepared from methanol and isobutene. Again, such a $C_4$ cut from the MTBE unit typically comprises around 50 wt % olefin. These $C_4$ cuts are fractionated at the outlet of the respective FCC or MTBE unit. The hydrocarbon feedstock may yet further comprise a $C_4$ cut from a naphtha steam-cracking unit of a petrochemical plant in which naphtha, comprising $C_5$ to $C_9$ species having a boiling point range of from about 15 to 180° C., is steam cracked to produce, inter alia, a $C_4$ cut. Such a $C_4$ cut typically comprises, by weight, 40 to 50% 1,3-butadiene, around 25% isobutylene, around 15% butene (in the form of but-1-ene and/or but-2-ene) and around 10% n-butane and/or isobutane. The olefin-containing hydrocarbon feedstock may also comprise a $C_4$ cut from a steam cracking unit after butadiene extraction (raffinate 1), or after butadiene hydrogenation.

The feedstock may yet further alternatively comprise a hydrogenated butadiene-rich $C_4$ cut, typically containing greater than 50 wt % $C_4$ as an olefin. Alternatively, the hydrocarbon feedstock could comprise a pure olefin feedstock which has been produced in a petrochemical plant.

The olefin-containing feedstock may yet further alternatively comprise light cracked naphtha (LCN) (otherwise known as light catalytic cracked spirit (LCCS)) or a $C_5$ cut from a steam cracker or light cracked naphtha, the light cracked naphtha being fractionated from the effluent of the FCC unit, discussed hereinabove, in a crude oil refinery. Both such feedstocks contain olefins. The olefin-containing feedstock may yet further alternatively comprise a medium cracked naphtha from such an FCC unit or visbroken naphtha obtained from a visbreaking unit for treating the residue of a vacuum distillation unit in a crude oil refinery.

The olefin-containing feedstock may comprise a mixture of one or more of the above-described feedstocks.

When converting light cracked naphtha, $C_2$ to $C_4$ olefins may be produced in accordance with the process of the invention. The $C_4$ fraction is very rich in olefins, especially in isobutene, which is an interesting feed for an MTBE unit. When converting a $C_4$ cut, $C_2$ to $C_3$ olefins are produced on the one hand and $C_5$ to $C_6$ olefins containing mainly iso-olefins are produced on the other hand. The remaining $C_4$ cut is enriched in butanes, especially in isobutane which is an interesting feedstock for an alkylation unit of an oil refinery wherein an alkylate for use in gasoline is produced from a mixture of $C_3$ and $C_5$ feedstocks. The $C_5$ to $C_6$ cut containing mainly iso-olefins is an interesting feed for the production of tertiary amyl methyl ether (TAME).

Surprisingly, the present inventors have found that in accordance with the process of the invention, olefinic feedstocks can be converted selectively so as to redistribute the olefinic content of the feedstock in the resultant effluent. The catalyst and process conditions are selected whereby the process has a particular yield on an olefin basis towards a specified olefin in the feedstocks. Typically, the catalyst and process conditions are chosen whereby the process has the same high yield on an olefin basis towards propylene irrespective of the origin of the olefinic feedstocks for example the $C_4$ cut from the FCC unit, the $C_4$ cut from the MTBE unit, the light cracked naphtha or the $C_5$ cut from the light crack naphtha, etc. This is quite unexpected on the basis of the published prior art. The propylene yield on an olefin basis is typically from 30 to 50% based on the olefin content of the feedstock. The yield on an olefin basis of a particular olefin is defined as the weight of that olefin in the effluent divided by the initial total olefin content by weight. For example, for a feedstock with 50 wt % olefin, if the effluent contains 20 wt % propylene, the propylene yield on an olefin basis is 40%. This may be contrasted with the actual yield for a product which is defined as the weight amount of the product produced divided by the weight amount of the feed. The paraffins and the aromatics contained in the feedstock are only slightly converted in accordance with the preferred aspects of the invention.

In accordance with preferred aspects of the present invention, the catalyst for the cracking of the olefins comprises a crystalline silicate of the MFI family which may be a zeolite, a silicalite or any other silicate in that family.

The preferred crystalline silicates have pores or channels defined by 10 oxygen rings and a high silicon/aluminium atomic ratio.

Crystalline silicates are microporous crystalline inorganic polymers based on a framework of $XO_4$ tetrahedra linked to each other by sharing of oxygen ions, where X may be trivalent (e.g. Al,B, . . . ) or tetravalent (e.g. Ge, Si, . . . ). The crystal structure of a crystalline silicate is defined by the specific order in which a network of tetrahedral units are linked together. The size of the crystalline silicate pore openings is determined by the number of tetrahedral units, or, alternatively, oxygen atoms, required to form the pores and the nature of the cations that are present in the pores. They possess a unique combination of the following properties: high internal surface area; uniform pores with one or more discrete sizes; ion exchangeability; good thermal stability; and ability to adsorb organic compounds. Since the pores of these crystalline silicates are similar in size to many organic molecules of practical interest, they control the ingress and egress of reactants and products, resulting in particular selectivity in catalytic reactions. Crystalline silicates with the MFI structure possess a bidirectional intersecting pore system with the following pore diameters: straight channel along [010]:0.53–0.56 nm and sinusoidal channel along [100]:0.51–0.55 nm.

The crystalline silicate catalyst has structural and chemical properties and is employed under particular reaction conditions whereby the catalytic cracking readily proceeds. Different reaction pathways can occur on the catalyst. Under the preferred process conditions, having an inlet temperature of around 500 to 600° C., more preferably from 520 to 600° C., yet more preferably 540 to 580° C., and an olefin partial pressure of from 0.1 to 2 bars, most preferably around atmospheric pressure, the shift of the double bond of an olefin in the feedstock is readily achieved, leading to double bond isomerisation. Furthermore, such isomerisation tends to reach a thermodynamic equilibrium. Propylene can be, for example, directly produced by the catalytic cracking of hexene or a heavier olefinic feedstock. Olefinic catalytic cracking may be understood to comprise a process yielding shorter molecules via bond breakage.

The catalyst preferably has a high silicon/aluminium atomic ratio, e.g. at least about 180, preferably greater than about 200, more preferably greater than about 300, whereby the catalyst has relatively low acidity. Hydrogen transfer reactions are directly related to the strength and density of the acid sites on the catalyst, and such reactions are preferably suppressed so as to avoid the formation of coke during the olefin conversion process, which in turn would otherwise decrease the stability of the catalyst over time. Such hydrogen transfer reactions tend to produce saturates such as paraffins, intermediate unstable dienes and cyclo-olefins, and aromatics, none of which favours cracking into light olefins. Cyclo-olefins are precursors of aromatics and coke-like molecules, especially in the presence of solid acids, i.e. an acidic solid catalyst. The acidity of the catalyst can be determined by the amount of residual ammonia on the catalyst following contact of the catalyst with ammonia which adsorbs to the acid sites on the catalyst with subsequent ammonium desorption at elevated temperature measured by differential thermogravimetric analysis. Preferably, the silicon/aluminium ratio ranges from 180 to 1000, most preferably from 300 to 500.

One of the features of the invention is that with such high silicon/aluminium ratio in the crystalline silicate catalyst, a stable olefin conversion can be achieved with a high propylene yield on an olefin basis of from 30 to 50% whatever the origin and composition of the olefinic feedstock. Such high ratios reduce the acidity of the catalyst, thereby increasing the stability of the catalyst.

The catalyst having a high silicon/aluminium atomic ratio for use in the catalytic cracking process of the present invention may be manufactured by removing aluminium from a commercially available crystalline silicate. A typical commercially available silicalite has a silicon/aluminium atomic ratio of around 120. The commercially available crystalline silicate may be modified by a steaming process which reduces the tetrahedral aluminium in the crystalline silicate framework and converts the aluminium atoms into octahedral aluminium in the form of amorphous alumina. Although in the steaming step aluminium atoms are chemically removed from the crystalline silicate framework structure to form alumina particles, those particles cause partial obstruction of the pores or channels in the framework. This inhibits the olefinic cracking processes of the present invention. Accordingly, following the steaming step, the crystalline silicate is subjected to an extraction step wherein amorphous alumina is removed from the pores and the micropore volume is, at least partially, recovered. The physical removal, by a leaching step, of the amorphous alumina from the pores by the formation of a water-soluble aluminium complex yields the overall effect of de-alumination of the crystalline silicate. In this way by removing aluminium from the crystalline silicate framework and then removing alumina formed therefrom from the pores, the process aims at achieving a substantially homogeneous de-alumination throughout the whole pore surfaces of the catalyst. This reduces the acidity of the catalyst, and thereby reduces the occurrence of hydrogen transfer reactions in the cracking process. The reduction of acidity ideally occurs substantially homogeneously throughout the pores defined in the crystalline silicate framework. This is because in the olefin cracking process hydrocarbon species can [en]ter deeply into the pores. Accordingly, the reduction of acidity and thus the reduction in hydrogen transfer reactions which would reduce the stability of the catalyst are pursued throughout the whole pore structure in the framework. In a preferred embodiment, the framework silicon/aluminium ratio is increased by this process to a value of at least about 180, preferably from about 180 to 1000, more preferably at least 200, yet more preferably at least 300, and most preferably around 480.

The crystalline silicate, preferably silicalite, catalyst is mixed with a binder, preferably an inorganic binder, and shaped to a desired shape, e.g. pellets. The binder is selected so as to be resistant to the temperature and other conditions employed in the catalyst manufacturing process and in the subsequent catalytic cracking process for the olefins. The binder is an inorganic material selected from clays, silica, metal oxides such as $ZrO_2$ and/or metals, or gels including mixtures of silica and metal oxides. The binder is preferably alumina-free. If the binder which is. used in conjunction with the crystalline silicate is itself catalytically active, this may alter the conversion and/or the selectivity of the catalyst. Inactive materials for the binder may suitably serve as diluents to control the amount of conversion so that products can be obtained economically and orderly without employing other means for controlling the reaction rate. It is desirable to provide a catalyst having a good crush strength. This is because in commercial use, it is desirable to prevent the catalyst from breaking down into powder-like materials. Such clay or oxide binders have been employed normally only for the purpose of improving the crush strength of the catalyst. A particularly preferred binder for the catalyst of the present invention comprises silica.

The relative proportions of the finely divided crystalline silicate material and the inorganic oxide matrix of the binder can vary widely. Typically, the binder content ranges from 5 to 95% by weight, more typically from 20 to 50% by weight, based on the weight of the composite catalyst. Such a mixture of crystalline silicate and an inorganic oxide binder is referred to as a formulated crystalline silicate.

In mixing the catalyst with a binder, the catalyst may be formulated into pellets, extruded into other shapes, or formed into a spray-dried powder.

Typically, the binder and the crystalline silicate catalyst are mixed together by an extrusion process. In such a process, the binder, for example silica, in the form of a gel is mixed with the crystalline silicate catalyst material and the resultant mixture is extruded into the desired shape, for example pellets. Thereafter, the formulated crystalline silicate is calcined in air or an inert gas, typically at a temperature of from 200 to 900° C. for a period of from 1 to 48 hours.

The binder preferably does not contain any aluminium compounds, such as alumina. This is because as mentioned above the preferred catalyst for use in the invention is de-aluminated to increase the silicon/aluminium ratio of the crystalline silicate. The presence of alumina in the binder yields other excess alumina if the binding step is performed prior to the aluminium extraction step. If the aluminium-containing binder is mixed with the crystalline silicate catalyst following aluminium extraction, this re-aluminates the catalyst. The presence of aluminium in the binder would tend to reduce the olefin selectivity of the catalyst, and to reduce the stability of the catalyst over time.

In addition, the mixing of the catalyst with the binder may be carried out either before or after the steaming and extraction steps.

The steam treatment is conducted at elevated temperature, preferably in the range of from 425 to 870° C., more preferably in the range of from 540 to 815° C. and at atmospheric pressure and at a water partial pressure of from 13 to 200kPa. Preferably, the steam treatment is conducted in an atmosphere comprising from 5 to 100% steam. The steam treatment is preferably carried out for a period of from 1 to 200 hours, more preferably from 20 hours to 100 hours. As stated above, the steam treatment tends to reduce the amount of tetrahedral aluminium in the crystalline silicate framework, by forming alumina.

Following the steam treatment, the extraction process is performed in order to de-aluminate the catalyst by leaching. The aluminium is preferably extracted from the crystalline silicate by a complexing agent which tends to form a soluble complex with alumina. The complexing agent is preferably in an aqueous solution thereof. The complexing agent may comprise an organic acid such as citric acid, formic acid, oxalic acid, tartaric acid, malonic acid, succinic acid, glutaric acid, adipic acid, maleic acid, phthalic acid, isophthalic acid, fumaric acid, nitrilotriacetic acid, hydroxyethylenediaminetriacetic acid, ethylenediaminetetracetic acid, trichloroacetic acid trifluoro-acetic acid or a salt of such an acid (e.g. the sodium salt) or a mixture of two or more of such acids or salts. The complexing agent for aluminium preferably forms a water-soluble complex with aluminium, and in particular removes alumina which is formed during the steam treatment step from the crystalline silicate. A particularly preferred complexing agent may comprise an amine, preferably ethylene diamine tetraacetic acid (EDTA) or a salt thereof, in particular the sodium salt thereof.

Following the de-alumination step, the catalyst is thereafter calcined, for example at a temperature of from 400 to 800° C. at atmospheric pressure for a period of from 1 to 10 hours.

The various preferred catalysts of the present invention have been found to exhibit high stability, in particular being capable of giving a stable propylene yield over several days, e.g. up to 10 days. This enables the olefin cracking process to be performed continuously in two parallel "swing" reactors wherein when one reactor is operating, the other reactor is undergoing catalyst regeneration. The catalyst of the present invention also can be regenerated several times. The catalyst is also flexible in that it can be employed to crack a variety of feedstocks, either pure or mixtures, coming from different sources in the oil refinery or petrochemical plant and having different compositions.

In the process for catalytic cracking of olefins in accordance with a preferred aspect of the invention, the present inventors have discovered that when dienes are present in the olefin-containing feedstock, this can provoke a faster deactivation of the catalyst. This can greatly decrease the yield on an olefin basis of the catalyst to produce the desired olefin, for example propylene, with increasing time on stream. It is desired in accordance with the process of the invention for the catalyst to have a stable activity over time, typically for at least 10 days.

In accordance with this preferred aspect of the invention, prior to the catalytic cracking of the olefins, hydrogen is added to the olefin-containing feedstock.

The catalytic cracking process can be performed in a fixed bed reactor, a moving bed reactor or a fluidized bed reactor. A typical moving bed reactor is of the continuous catalytic reforming type. As described above, the process may be performed continuously using a pair of parallel "swing" reactors.

Since the catalyst exhibits high stability to olefinic conversion for an extended period, typically at least around 10 days, the frequency of regeneration of the catalyst is low.

More particularly, the catalyst may accordingly have a lifetime which exceeds one year.

After the catalytic cracking process, the reactor effluent is sent to a fractionator and the desired olefins are separated from the effluent. The $C_3$ cut, containing at least 95% propylene, is fractionated and thereafter purified in order to remove all the contaminants such as sulphur species, arsine, etc. The heavier olefins of greater than $C_3$ can be recycled.

The present inventors have found that the use of a silicalite catalyst in accordance with an aspect of the present invention which has been steamed and extracted, has particular resistance to reduction in the catalyst activity (i.e. poisoning) by sulphur-, nitrogen- and oxygen-containing compounds which are typically present in the feedstocks.

In accordance with various aspects of the present invention, not only can a variety of different olefinic feedstocks be employed in the cracking process, but also, by appropriate selection of the process conditions and of the particular catalyst employed, the olefin conversion process can be controlled so as to produce selectively particular olefin distributions in the resultant effluents.

For example, in accordance with a primary aspect of the invention, olefin-rich streams from refinery or petrochemical plants are cracked into light olefins, in particular propylene. The light fractions of the effluent, namely the $C_2$ and $C_3$ cuts, can contain more than 95% olefins. Such cuts are sufficiently pure to constitute chemical grade olefin feedstocks. The present inventors have found that the propylene yield on an olefin basis in such a process can range from 30 to 50% based on the olefinic content of the feedstock which contains one or more olefins of $C_4$ or greater. In the process, the effluent has a different olefin distribution as compared to that of the feedstock, but substantially the same total olefin content.

In the catalytic cracking process, the process conditions are selected in order to provide high selectivity towards propylene, a stable olefin conversion over time, and a stable olefinic product distribution in the effluent. Such objectives are favoured by the use of a low acid density in the catalyst (i.e. a high Si/Al atomic ratio) in conjunction with a low pressure, a high inlet temperature and a short contact time, all of which process parameters are interrelated and provide an overall cumulative effect (e.g. a higher pressure may be offset or compensated by a yet higher inlet temperature). The process conditions are selected to disfavour hydrogen transfer reactions leading to the formation of paraffins, aromatics and coke precursors. The process operating conditions thus employ a high space velocity, a low pressure and a high reaction temperature. Preferably, the LHSV ranges from 10 to 30 $h^{-1}$. The olefin partial pressure preferably ranges from 0.1 to 2 bars, more preferably from 0.5 to 1.5 bars. A particularly preferred olefin partial pressure is atmospheric pressure (i.e. 1 bar). The hydrocarbon feedstocks are preferably fed at a total inlet pressure sufficient to convey the feedstocks through the reactor. The hydrocarbon feedstocks may be fed undiluted or diluted in an inertgas, e.g. nitrogen. Preferably, the total absolute pressure in the reactor ranges from 0.5 to 10 bars. The present inventors have found that the use of a low olefin partial pressure, for example atmospheric pressure, tends to lower the incidence of hydrogen transfer reactions in the cracking process, which in turn reduces the potential for coke formation which tends to reduce catalyst stability. The cracking of the olefins is preferably performed at an inlet temperature of the feedstock of from 500 to 600° C., more preferably from 520 to 600° C., yet more preferably from 540 to 580° C., typically around 560° C. to 570° C.

In accordance with a preferred aspect of the present invention, the hydrogen gas has been introduced into the olefin-containing feedstock preferably at a hydrogen partial pressure of up to about 7.5 bar. Typically, the addition of hydrogen to the feedstock permits doubling of the cycle time between successive regenerations of the catalyst. The use of hydrogen in the feedstock also obviates the need for selective hydrogenation of the dienes prior to the olefin cracking process. At low hydrogen partial pressures, typically below around 5 bar, the propylene purity i.e. the amount by weight of propylene with respect to the total $C_3$ species present is high. At higher partial pressure of hydrogen, for example up to 15 bar, the higher hydrogen partial pressure tends to convert propylene to propane, yielding a low propylene purity in the $C_3$ species, even though the catalyst stability remains higher. Typically, the catalyst remains stable using hydrogen addition to the feedstock over periods up to 10 days, giving a propylene yield of greater than about 15 wt % starting from a $C_4$ feedstock. The propylene yield on an olefins basis is typically greater than 30% over a corresponding period when hydrogen addition to the olefin-containing feedstock is employed.

Referring to FIG. 1, there is shown a schematic diagram of a process for cracking an olefin-rich hydrocarbon feedstock in accordance with an embodiment the invention in which ethylene in the effluent is recycled back to the feedstock. Since hydrogen has also been added to the feedstock, hydrogen is recycled from the effluent back to the feedstock together with the ethylene.

A catalytic cracking apparatus, designated generally as 52, includes two serially connected reactors 54,56 with the feedstock being fed into the reactor 54 and effluent being outputted from the reactor 56. The two reactors 54,56 have respectively provided upstream thereof a first or second heating device 58,60. The reactors 54,56 are arranged as parallel (swing) reactors together with reactors 54',56'. In use, the reactors 54,56 are operated for a period known as a cycle time which typically equals a number of days. When the catalyst in the reactors 54,56 requires regeneration, the reactors 54,56 are swung out of the flow line for the feedstock and effluent and the parallel reactors 54',56' are swung into position and operated. While the reactors 54',56' are operating, the catalyst present in the reactors 54,56 is regenerated.

An olefin-containing hydrocarbon feedstock is fed to a first inlet 62 of a feed line 64 which communicates with the first heating device 58. A second inlet 66 is provided in the feed line 64 for feeding hydrogen gas to the feedstock. An outlet line 68 for the second reactor 56 is provided with an intermediate heat recovery device 70 and communicates with a separating device 72. The separating device 72 is adapted to separate from the hydrocarbon effluent by fractionation the light ends, comprising hydrogen, methane, ethane and ethylene.

The light ends are fed along a line 74 to a purge point 76 at which a portion of the light ends are removed to prevent build up of the light paraffins, namely methane and ethane, in the reactors 54,56. The remaining light ends are fed to a compressor 78 for feeding compressed flow of the light ends, including hydrogen and ethylene, along a line 80 from the compressor 78 to a third inlet 82 of feed line 64 for introducing ethylene and hydrogen into the feedstock upstream of the first heating device 58.

From the separator 72, the fraction of the effluent which is heavier than the light ends, i.e. $C_3$+ hydrocarbons, are fed along a line 84 to a serial cascade of fractionation devices 86,88. In the first fractionation device 86, the effluent is fractionated to separate the $C_3$ hydrocarbons from the remaining heavier hydrocarbons. The $C_3$ hydrocarbons are outputted along line 90 and the $C_4$+ hydrocarbons are feed to the second fractionation device 88 along line 92. In the second fractionation device 88, the $C_4$ hydrocarbons are separated so as to be outputted along line 94 and the remaining $C_5$+ hydrocarbons, comprising both paraffinic and olefinic species and possibly any aromatic species, are fed along a line 96 via a purge point 98 to the feed line 64 via a fourth inlet 100 thereof. At the purge point 98, some of the $C_5$+ species are removed to avoid build-up of a heavy fraction and paraffins in the catalytic cracker reactors 54,56.

The propylene product is outputted along line 90 together with some small level of propane. Typically, the purity of the propylene is greater than about 90 wt %. If desired, the $C_4$ fraction removed along line 94 may be recycled into the hydrocarbon feedstock.

The present invention is now illustrated by way of example only with reference to the following non-limiting Examples.

EXAMPLE 1

Figure 2:
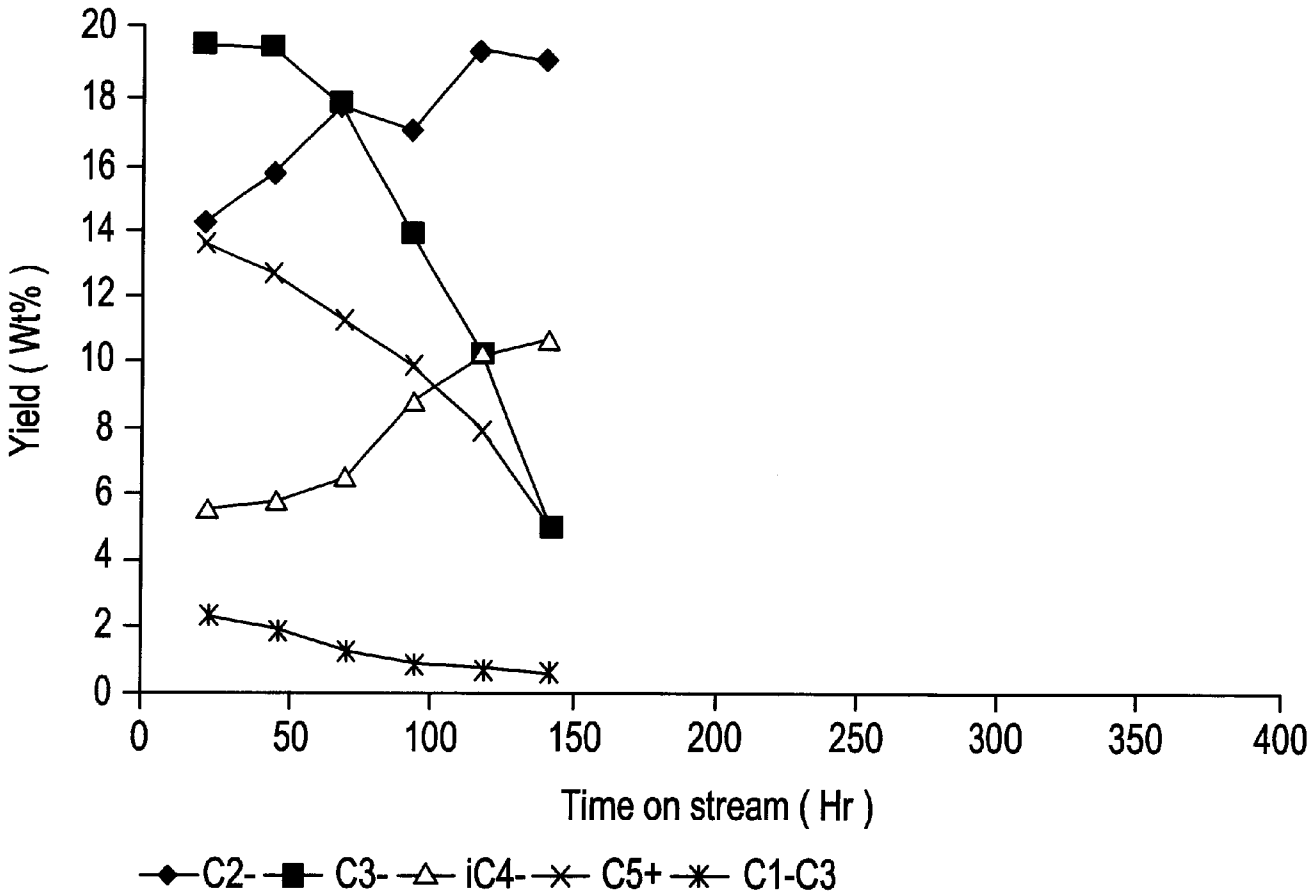
FIG. 2 shows the relationship between the yield of, inter alia, propylene with time for a feedstock to which ethylene has been added prior to catalytic cracking in accordance with a first Example of the invention.

In this Example, a $C_4$ hydrocarbon feedstock from an MTBE unit was subjected to catalytic cracking in the presence of an aluminosilicate catalyst. The catalyst comprised a commercially available silicalite which had been subjected to a dealumination treatment so as to provide a silicon/aluminium atomic ratio of around 272. In the preparation of the catalyst, a silicalite available in commerce under the product designation S115 from UOP of Chickasaw, United States of America was treated at 550° C. with steam containing 72 volume percent of steam and 28 volume percent of nitrogen at atmospheric pressure for a period of 48 hours. Thereafter, 2 kg of the steamed catalyst were immersed in 8.4 liters of an aqueous solution containing 0.057M of $Na_2EDTA$ and refluxed for a period of 18 hours. The resulting slurry was washed thoroughly with water. Then, 640 g of the above-treated silicalite were mixed together with 112 g of precipitated silica, available in commerce under trade designation FK500 from Degussa, Frankfurt, Germany and 726 g of a 40 wt % silica sol, available in commerce from Akzo-Nobel of Germany under the trade designation Nyacol 2040, with the components being mixed together with 500 ml of distilled water. The slurry so formed was mixed for a period of 0.5 hours. Subsequently, 10 g of a poly-electrolyte available in commerce from Nalco Chemical BV, Netherlands, under the trade designation Nalco 9779 and 30 g of tylose were added. The slurry was evaporated until a paste was obtained. This paste was extruded to form 2.5 mm quadrolobe extrudates. The extrudates were dried at 110° C. for a period of 16 hours and then calcined for a period of 10 hours at a temperature of 600° C. Finally, the catalyst was exchanged with ammo nium chloride in an amount of 4.2 liters of 0.5N ammonium chloride per kg of catalyst under reflux conditions and washed, dried at 110° C. and calcined at 400° C. for a period of 3 hours. The resulting catalyst had the following composition in weight percent $Al_2O_3$ 0.3110, $Na_2O$ 0.0091, $K_2O$ 0.0020, CaO 0.015, $Fe_2O_3$ 0.0590 and the balance $SiO_2$. The silicon/aluminium atomic ratio in the catalyst was 271.9 and the loss on ignition was 1.60 wt %. The hydrocarbon feedstock had the composition illustrated in Table 1. Ethylene was added to the feedstock to provide a molar ratio of butene to ethylene of 1. This constituted a very high ethylene concentration in the feedstock. The feedstock was passed over the catalyst at a temperature of 558° C., a weight hourly space velocity (WHSV) of 12.5 $h^{-1}$ and at a total hydrocarbon partial pressure (including that of ethylene) of 1.5 bara. The yield in terms of weight percent of various constituents in the effluent was measured over time and the results are shown in FIG. 2. It may be seen that the use of ethylene initially increases the propylene yield to nearly 20 wt % in the effluent. After around 50 hours on stream, the propylene amount in the effluent decreased, indicating that the catalyst was not particularly stable. Nevertheless, this shows that the addition of ethylene to the hydrocarbon feedstock, containing primarily $C_4$ hydrocarbons, tended to increase the propylene yield.

EXAMPLE 2

Figure 3:
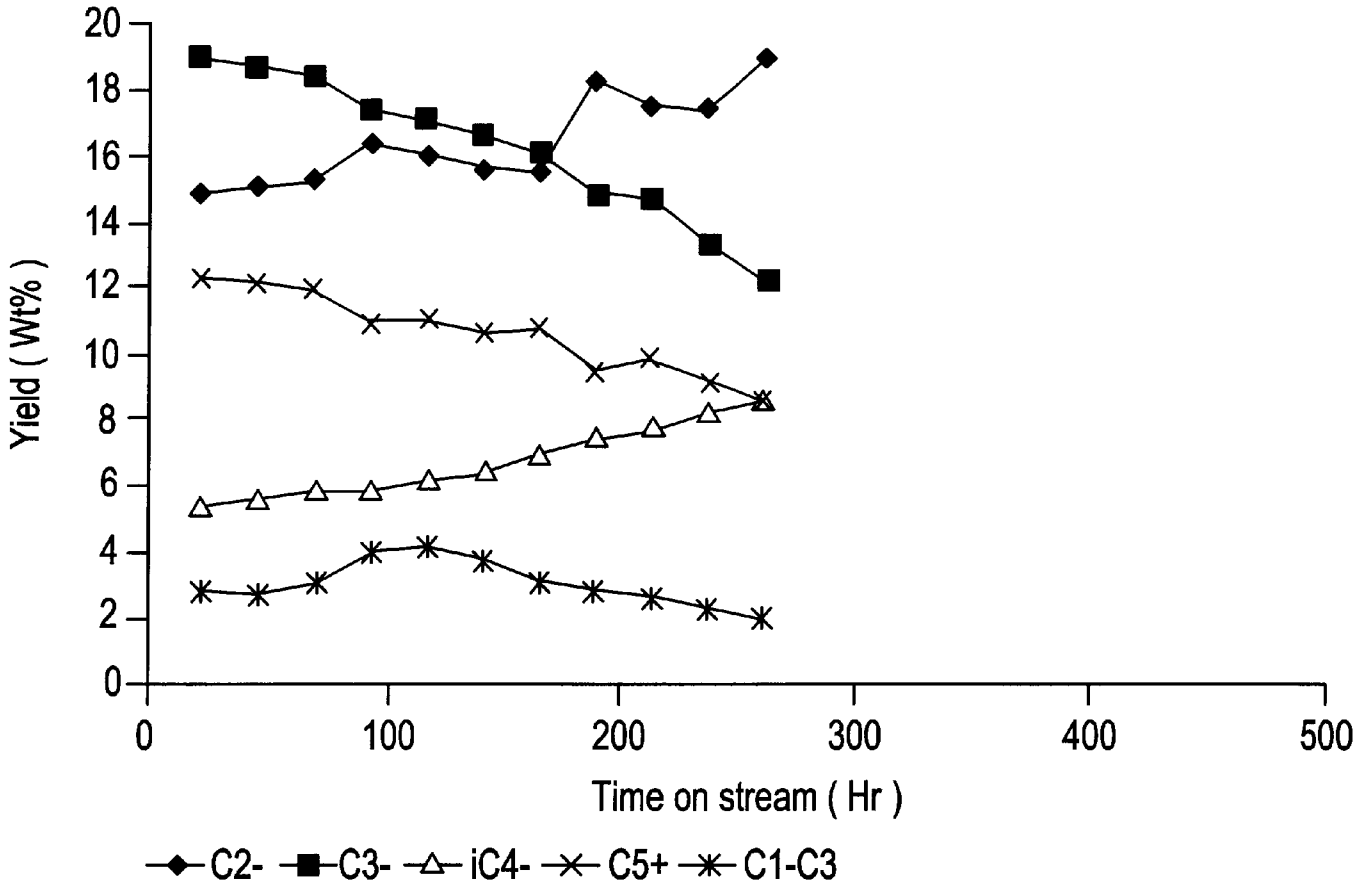
FIG. 3 shows the relationship between the yield of various products including propylene, and time for a selective catalytic cracking process in accordance with a second Example of the invention.

In this Example, the same feedstock for Example 1 had the same amount of ethylene added to the feedstock before the olefin cracking process. In other words, the butene/ethylene molar ratio was 1. In addition, hydrogen was added to the feedstock. The partial pressure of the hydrocarbons, including ethylene, was 1.5 bar and the partial pressure of the hydrogen was 3.5 bar, yielding a total feedstock pressure of 5 bara. The combined feedstock/ethylene was fed at a weight hourly space velocity (WHSV) of 13 $h^{-1}$ and at a temperature of 560° C. over the same catalyst employed in Example 1. The composition of the various components in the effluent was detected over increasing time on stream and the results are shown in FIG. 3 and table 2. It may be seen from FIG. 3 and Table 2 that the addition of ethylene to the hydrocarbon feedstock tends to increase the propylene yield to around 9 wt % in the effluent. This yield decreases over time, but as a reduced rate as compared to Example 1 due to the addition of hydrogen to the feedstock.

Figure 4:
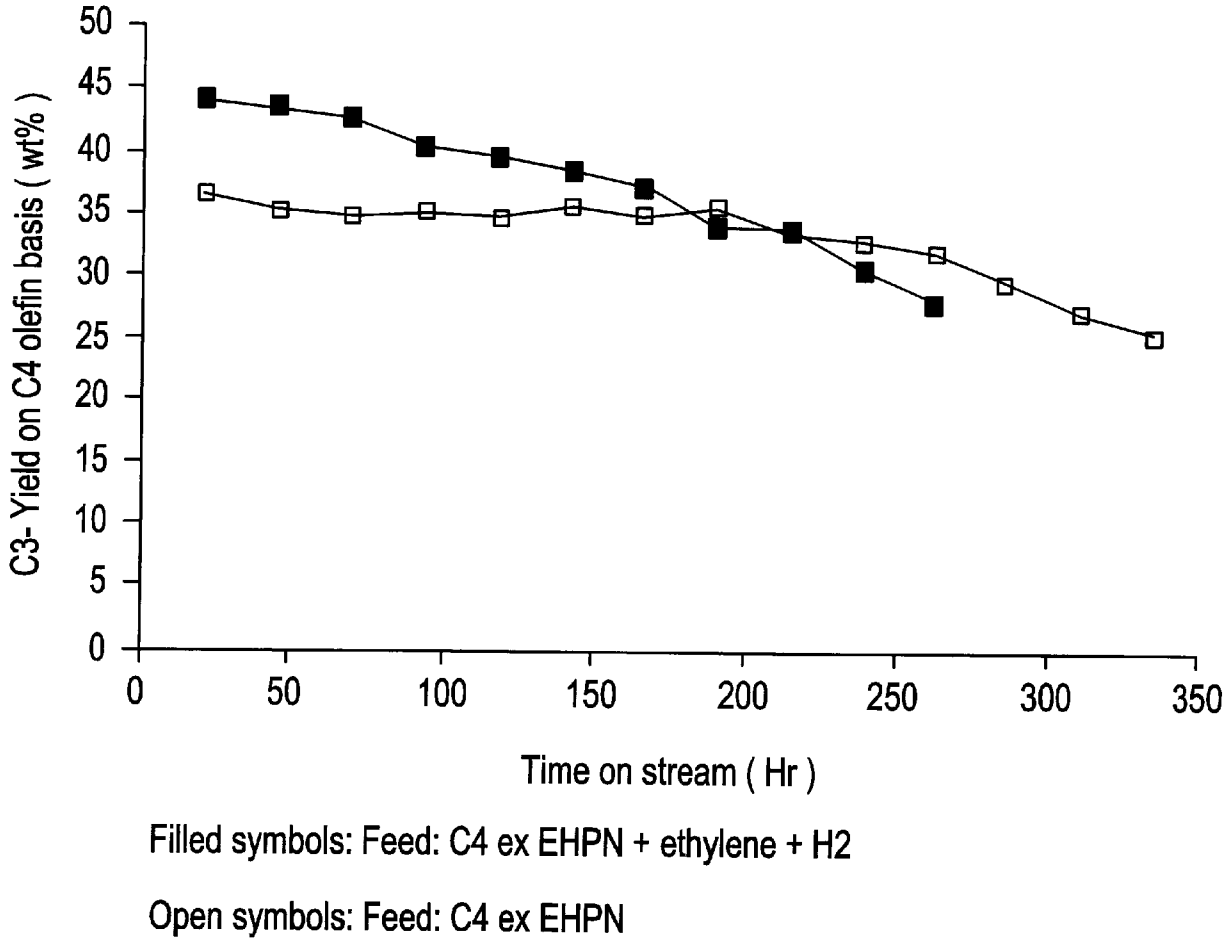
FIG. 4 shows the relationship between the yield of various products including propylene, and time for a selective catalytic cracking process in accordance with a third Example of the invention.

As a comparison, FIG. 4 also shows the propylene yield on a $C_4$ olefin basis for the $C_4$ feedstock alone having being subjected to the same catalytic cracking process. It may be seen from FIG. 4 that in accordance with the invention in which both ethylene and hydrogen are introduced into the feedstock before the catalytic cracking process (as shown by the plotted line with the filled symbols), the propylene yield on a $C_4$ olefin basis remains high over a period of over 10 days and initially is up to around 45 wt %. Even after 10 days the propylene yield on a $C_4$ olefin basis is around 30 wt %. In contrast, when ethylene and hydrogen are not added to the $C_4$ feedstock (as shown by the plotted line with the open symbols), the propylene yield on a $C_4$ olefin basis is lower, around 35 wt % over that 10 day period. Thus the yield of propylene tends to be increased by introducing ethylene into the hydrocarbon feedstock.

TABLE 1

| COMPOSITION COMPOUND | | Tin = 558° C. IN [wt %] | OUT [wt %] |
|---|---|---|---|
| Paraffins | | 36.8143 | 40.0974 |
| Olefins | | 63.1263 | 56.9347 |
| Dienes | | 0.0594 | 0.2592 |
| Aromatics | | 0.0000 | 2.7087 |
| Total | | 100.0000 | 100.0000 |
| Average M.W. | | 47.1533 | 47.7818 |
| Summary OF TOTAL | | | |
| C1 | P1 | 0.0050 | 0.3592 |
| C2 | P2 | 0.0000 | 0.5545 |
| | O2 | 20.1216 | 14.2560 |
| C3 | P3 | 0.3820 | 1.4469 |
| | O3 | 0.1556 | 19.5547 |
| | D3 | 0.0069 | 0.0034 |
| C4 | iP4 | 25.7780 | 25.1400 |
| | nP4 | 10.4371 | 10.7247 |
| | iO4 | 1.7653 | 5.5262 |
| | nO4 | 41.0404 | 8.7285 |
| | D4 | 0.0525 | 0.1059 |
| C5 | iP5 | 0.2122 | 0.4337 |
| | nP5 | 0.0000 | 0.1443 |
| | cP5 | 0.0000 | 0.3818 |
| | iO5 | 0.0408 | 3.6643 |
| | nO5 | 0.0000 | 1.9409 |
| | cO5 | 0.0000 | 0.1877 |
| | D5 | 0.0000 | 0.1485 |
| C6 | iP6 | 0.0000 | 0.0392 |
| | nP6 | 0.0000 | 0.0684 |
| | cP6 | 0.0000 | 0.4514 |
| | iO6 | 0.0000 | 0.9281 |
| | nO6 | 0.0026 | 1.4461 |
| | cO6 | 0.0000 | 0.0597 |
| | D6 | 0.0000 | 0.0014 |
| | A6 | 0.0000 | 0.5693 |
| C7 | iP7 | 0.0000 | 0.0672 |
| | nP7 | 0.0000 | 0.0046 |
| | cP7 | 0.0000 | 0.1709 |
| | nO7 | 0.0000 | 0.2227 |
| | iO7 | 0.0000 | 0.0904 |
| | cO7 | 0.0000 | 0.3295 |
| | D7 | 0.0000 | 0.0000 |
| | A7 | 0.0000 | 1.0884 |
| C8 | iP8 | 0.0000 | 0.0941 |
| | nP8 | 0.0000 | 0.0000 |
| | cP8 | 0.0000 | 0.0165 |
| | iO8 | 0.0000 | 0.0000 |
| | nO8 | 0.0000 | 0.0000 |
| | cO8 | 0.0000 | 0.0000 |
| | A8 | 0.0000 | 1.0510 |
| | | 100.0000 | 100.0000 |
| C5 + liquid | | 0.2557 | 13.5999 |
| C2-/C2 | | 100.0000 | 96.2558 |
| C3-/C3 | | 28.9424 | 93.1104 |
| C4-/C4 | | 54.1343 | 28.3814 |
| C5-/C5 | | 16.1361 | 83.9417 |
| C6-/C6 | | 100.0000 | 68.2998 |
| C7-/C7 | | — | 32.5588 |
| C8-/C8 | | — | 0.0000 |

TABLE 2

| COMPOSITION COMPOUND | Tin = 560° C. IN [wt %] | OUT [wt %] |
|---|---|---|
| Paraffins | 36.8143 | 41.9622 |
| Olefins | 63.1263 | 55.7064 |

TABLE 2-continued

| COMPOSITION COMPOUND | | Tin = 560° C. IN [wt %] | OUT [wt %] |
|---|---|---|---|
| Dienes | | 0.0594 | 0.2230 |
| Aromatics | | 0.0000 | 2.1084 |
| Total | | 100.0000 | 100.0000 |
| Average M.W. | | 47.1533 | 47.2009 |
| Summary OF TOTAL | | | |
| C1 | P1 | 0.0050 | 0.4732 |
| C2 | P2 | 0.0000 | 0.8118 |
| | O2 | 20.1216 | 14.9360 |
| C3 | P3 | 0.3820 | 1.5159 |
| | O3 | 0.1556 | 19.0028 |
| | D3 | 0.0069 | 0.0030 |
| C4 | iP4 | 25.7780 | 25.9549 |
| | nP4 | 10.4371 | 11.1163 |
| | iO4 | 1.7653 | 5.3601 |
| | nO4 | 41.0404 | 8.3942 |
| | D4 | 0.0525 | 0.1069 |
| C5 | iP5 | 0.2122 | 0.7288 |
| | nP5 | 0.0000 | 0.2120 |
| | cP5 | 0.0000 | 0.3028 |
| | iO5 | 0.0408 | 3.4681 |
| | nO5 | 0.0000 | 1.8025 |
| cO5 | 0.0000 | 0.1575 | |
| | D5 | 0.0000 | 0.1132 |
| C6 | iP6 | 0.0000 | 0.1175 |
| | nP6 | 0.0000 | 0.0369 |
| | cP6 | 0.0000 | 0.3814 |
| | iO6 | 0.0000 | 0.8679 |
| | nO6 | 0.0026 | 1.1073 |
| | cO6 | 0.0000 | 0.0502 |
| | D6 | 0.0000 | 0.0000 |
| | A6 | 0.0000 | 0.4972 |
| C7 | iP7 | 0.0000 | 0.0783 |
| | nP7 | 0.0000 | 0.0072 |
| | cP7 | 0.0000 | 0.1447 |
| | nO7 | 0.0000 | 0.1909 |
| | iO7 | 0.0000 | 0.0769 |
| | cO7 | 0.0000 | 0.2920 |
| | D7 | 0.0000 | 0.0000 |
| | A7 | 0.0000 | 0.8916 |
| C8 | iP8 | 0.0000 | 0.0707 |
| | nP8 | 0.0000 | 0.0000 |
| | cP8 | 0.0000 | 0.0097 |
| | iO8 | 0.0000 | 0.0000 |
| | nO8 | 0.0000 | 0.0000 |
| | cO8 | 0.0000 | 0.0000 |
| | A8 | 0.0000 | 0.7196 |
| | | 100.0000 | 100.0000 |
| C5 + liquid | | 0.2557 | 12.3250 |
| C2-/C2 | | 100.0000 | 94.8452 |
| C3-/C3 | | 28.9424 | 92.6122 |
| C4-/C4 | | 54.1343 | 27.0051 |
| C5-/C5 | | 16.1361 | 80.0021 |
| C6-/C6 | | 100.0000 | 66.2252 |
| C7-/C7 | | — | 33.2898 |
| C8-/C8 | | — | 0.0000 |

What is claimed is:

1. A process for cracking an olefin-rich hydrocarbon feedstock which is selective towards propylene in the effluent, the process comprising contacting a hydrocarbon feedstock containing one or more olefinic components of $C_4$ or greater with a crystalline silicate catalyst to produce an effluent having a second composition of one or more olefinic components of $C_3$ or greater, the feedstock and the effluent having substantially the same olefin content by weight therein whereby ethylene is added to the feedstock before the feedstock contacts the catalyst.

2. A process according to claim 1 wherein at least a part of the ethylene is recycled from the effluent.

3. A process according to claim 1 wherein the ethylene comprises from 0.1 to 50 wt % of the hydrocarbon feedstock.

4. A process according to claim 1 further comprising recycling at least a part of $C_5$ or greater olefins from the effluent to the feedstock.

5. A process according to claim 1 further comprising adding to the feedstock hydrogen gas at a hydrogen partial pressure of up to 7.5 bar.

6. A process according to claim 5 wherein the hydrogen partial pressure is from 0.1 to 5 bar.

7. A process according to claim 5 wherein at least a part of the hydrogen is recycled from the effluent.

8. A process according to claim 7 wherein both ethylene and hydrogen are together recycled as a common stream back into the feedstock from the effluent.

9. A process according to claim 1 wherein the catalyst comprises silicalite.

10. A process according to claim 1 wherein the catalyst has a silicon/aluminium atomic ratio of at least 180.

11. A process according to claim 1 wherein the feedstock comprises a light cracked naphtha, a $C_4$ cut from a fluidised-bed catalytic cracking unit in a refinery, a $C_4$ cut from a unit in a refinery for producing methyl tert-butyl ether or a $C_4$ cut from a steam-cracking unit.

12. A process according to claim 1 wherein the catalytic cracking has a propylene yield on an olefin basis of from 30 to 50% based on the olefin content of the feedstock.

13. A process according to claim 1 wherein the olefin contents by weight of the feedstock and of the effluent are within ±15% of each other.

14. A process according to claim 1 wherein the feedstock contacts the catalyst at an inlet temperature of from 500 to 600° C.

15. A process according to claim 14 wherein the inlet temperature is from 540 to 580° C.

16. A process according to claim 1 wherein the feedstock contacts the catalyst at an olefin partial pressure of from 0.1 to 2 bar.

17. A process according to claim 16 wherein the olefin partial pressure is around atmospheric pressure.

18. A process according to claim 1 wherein the feedstock is passed over the catalyst at an LHSV of from 10 to 30 $h^{-1}$.

19. A process according to claim 1 wherein the feedstock has a maximum diene concentration therein of 0.1 wt %.

20. A process for cracking an olefin-rich hydrocarbon feedstock which is selective towards propylene in the effluent, the process comprising contacting a hydrocarbon feedstock containing one or more olefinic components of $C_4$ or greater with a crystalline silicate catalyst having a silicon/aluminium atomic ratio of at least 180 at an inlet temperature of from 500 to 600° C., an olefin partial pressure of from 0.1 to 2 bar and an LHSV of from 10 to 30 $h^{-1}$, to produce an effluent having a second composition of one or more olefinic components of $C_3$ or greater, the feedstock and the effluent having substantially the same olefin content by weight therein and ethylene recycled from the effluent is added to the feedstock before the feedstock contacts the catalyst.

* * * * *